US006129636A

United States Patent [19]

Tuten et al.

[11] Patent Number: 6,129,636

[45] Date of Patent: Oct. 10, 2000

[54] ADVANCED PINSPOTTER CONTROLS AND METHOD THEREFOR

[76] Inventors: William J. Tuten, 8708 E. Malcomb Dr., Scottsdale, Ariz. 85253; Kennith D. Crosby, 10199 E. Sweetwater, Scottsdale, Ariz. 85260

[21] Appl. No.: 08/938,794

[22] Filed: Sep. 26, 1997

Related U.S. Application Data

[63] Continuation-in-part of application No. 08/558,625, Nov. 13, 1995, Pat. No. 5,803,819.

[51] Int. Cl.[7] ..... A63D 5/00

[52] U.S. Cl. ..... 473/102; 473/54

[58] Field of Search ..... 473/54, 64, 65, 473/73, 101, 102; 700/91, 92, 93; 340/323 R, 323 B

[56] References Cited

U.S. PATENT DOCUMENTS 5,101,354 3/1992 Mowers et al. ..... 473/65
5,437,576 8/1995 Tuten et al. ..... 473/54
5,803,819 9/1998 Tuten et al. ..... 473/102

*Primary Examiner*—Mark A. Sager
*Attorney, Agent, or Firm*—Harry M. Weiss; Jeffrey Weiss; Paul W. Davis

[57] ABSTRACT

A pinspotter controller system, and a method therefore, is disclosed which provides improved functional characteristics over old pinspotter control systems. The heart of the pinspotter control system is an all solid state pinspotter controller chassis which can be coupled to a pinspotter for controlling the operation of the pinspotter. The all solid state pinspotter controller provides circuitry for executing a short strike cycle; for cutting power to a back end motor to conserve energy; and for coupling to a remote control console. The solid state pinspotter controller retains status and position data for the pinspotter during power interruptions. The combination also replaces the current AMF 8270 chassis, contains a buffering mechanism to prevent false operation, and contains a new communication module. The new combination disclosed here has improved backend control through the use of a microprocessor, reduced wiring, positive management and control, and improved braking when operating at 230 Volts AC.

25 Claims, 7 Drawing Sheets

ADVANCED PINSPOTTER CONTROLS AND METHOD THEREFOR

RELATED PATENTS

This application is a continuation-in-part of U.S. patent application Ser. No. 08/558,625, with filing date of Nov. 13, 1995 is now U.S. Pat. No. 5,803,819, in accordance with C.F.R. § 1,53(b)(1). This patent application is also related to issued U.S. Pat. No. 5,437,576 entitled "COMBINATION BOWLING PINSPOTTER AND PINSPOTTER CONTROL SYSTEM AND METHOD THEREFOR", in the name of the same inventor, and is incorporated herein by reference.

FIELD OF THE INVENTION

This invention relates generally to bowling pinspotter systems and, more specifically, to an all solid state pinspotter controller system, and method therefor, which provides improved backend control through the use of a microprocessor, reduced wiring, positive management control, improved breaking and other new and enhanced pinspotter control functions.

DESCRIPTION OF THE PRIOR ART

The earliest bowling pinspotters were manual. In the late 1940's and the early 1950's automatic mechanical pinspotters were designed. These early mechanical pinspotters, such as the AMF 4000, were more reliable and efficient then manual pinspotters. The automatic pinspotters were improved by using electro-mechanical controllers, e.g. AMF 5850/6525. Between the late 1960's and the early 1970's the AMF 8270 was designed. The AMF 8270 was more reliable, reduced the time required to bowl a game, and had greater options than previous pinspotters. Three models of the AMF 8270 currently exist. The model designations are A, B, and C; with the C model being the most widely used. The original controller for the AMF 8270 used a combination of solid state and electro-mechanical controllers.

Early in 1994, the first all solid state chassis was invented. See U.S. Pat. No. 5,437,576, Tuten et. al. In addition to being more reliable and efficient, the all solid state pinspotter controller enabled the system to automatically finish a cycle prior to shutting down in order to avoid potential damage. The original solid state chassis was improved to be able to replace the AMF 8270 chassis, to include a buffering mechanism which will prevent false operation, and to include a communication module to correspond with a remote location, along with other advantages and features. See U.S. patent application Ser. No. 08/558,625, Tuten, et. al., which is incorporated into the present document. Further improvements to the prior art are now being addressed by this invention. The prior art devices lacked accurate and efficient backend control; they had excessive wiring; lacked positive management control; and lacked accurate and efficient braking control when operating at 230 VAC. The present invention contains these and other improvements over the prior art.

SUMMARY OF THE INVENTION

In accordance with one embodiment of the present invention, it is an object of the present invention to provide an improved solid state chassis in combination with a microprocessor based backend controller which results in positive control of the pinspotter backend controller.

It is another object of this invention to provide an improved solid state chassis and associated control devices which results in reduced wiring.

It is a further object of this invention to provide an improved solid state chassis in combination with a microprocessor based backend controller which provides improved functionality and control for the bowling pinspotter and pinspotter controller combination.

It is yet another object of this invention to provide an improved motor wiring design in combination with the pinspotter controller which results in improved breaking when operating at 230 VAC.

It is yet another object of this invention to provide selectable options heretofore not envisioned to provide more flexible bowling benefits to the bowler and proprietor.

BRIEF DESCRIPTION OF THE PREFERRED EMBODIMENT

The bowling pinspotter and pinspotter controller system can best be understood by assuming that the unit is initially powered and awaiting the first ball to be rolled in the first frame of a game of bowling. The first ball is rolled and, with luck or skill, some pins are knocked down. We first assume that not all pins are knocked down. The ball then strikes a rear cushion which has an associated switch. The switch sends a start signal to the controller. The controller then initiates a first ball cycle. The first ball cycle consists of: (1) the sweep moving to a forward down position which prevents any subsequently thrown ball from striking the pinspotter mechanisms; after a short time delay, (2) the table is driven down and the pins which remain standing fit into holes in the base of the table; (3) the pin grippers which are internal to the table, above each pin hole, sense and grab the standing pins; (4) the table is driven up; (5) the sweep moves towards the rear of the pinspotter forcing the fallen pins to a collection point in the back of the pinspotter; (6) the sweep then reverses course and returns to the forward down position; (7) the table then lowers; (8) the pin grippers release the pins; (9) the table and the sweep rise to their resting positions. The second ball is then rolled. Again we assume that not all pins are knocked down. The second ball cycle begins. The second ball cycle consists of (1) the sweep moving to a forward down position; after a short delay, (2) the sweep cleans the pin deck and returns to forward down position; (3) the spotting latch is activated and a new set of pins is spotted; (4) the sweep and table return to their home position. During each cycle, the pinspotter chassis receives from the scoring system data concerning the standing pins.

The pinspotter accomplishes these feats by communicating with a manager's console, a manager's area control, a scoring system, and a backend controller. The backend controller is a key device typically located between two pinspotters which allows a mechanic to control the two pinspotters. In addition, the backend controller may have the ability to receive instructions from the manager's area controller through a communications network and to communicate the status of the pinspotters to the mechanic.

This above description is for a typical frame of bowling. In addition to a typical game, the operator may wish to choose several options, or the bowler may bowl a strike which eliminates the need for a second ball cycle. The options include a tenth frame cycle and a foul signal which are initiated from the bowler's area. The options also include a table, backend, and sweep disable switch; and a pinspotter power switch from the backend controller. The options further include a bowl, off and instructomat cycle from the manager's console. With the current invention the manager's area controller or the operator at the backend controller can choose additional options such as nine-pin-strike, instructomat, gripper-switch-override, off-spot, first-ball-only, third-ball, normal-cycle, foul, cycle timing and backend-motor-control.

In accordance with one embodiment of the present invention, a solid state chassis for controlling the operation of a bowling pin pinspotter in combination with a microprocessor based backend controller is disclosed. The chassis includes a microcomputer for controlling the operation of the chassis by receiving inputs from a plurality of elements coupled to the microcomputer and producing an output signal to control the chassis based on the inputs. With the present invention the backend controller includes a microprocessor for controlling the operation of the chassis by communicating with the chassis and other pinspotter related devices.

In accordance with another embodiment of the present invention, the improved microprocessor based controls allow for simpler wiring techniques such as serial data communication links. These simpler wiring methods lead to more efficient and reliable operation of the pinspotter and easier installation.

Another embodiment of the present invention is a press key pad interface for the backend controller which allows the mechanic at the backend controller to either select the options which are available from the manager's area controller, or to set the controller to respond to the manager's area controller. In addition, the press key pad interface has multiple indicator lights to indicate the current status of the pinspotter operation.

Another embodiment of the current invention allows for improved breaking of the motors associated with the pinspotter when they are operated at 230 VAC. This is accomplished by removing a triac component from the wiring of the breaking system for the motor The breaking system being a part of the chasis.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
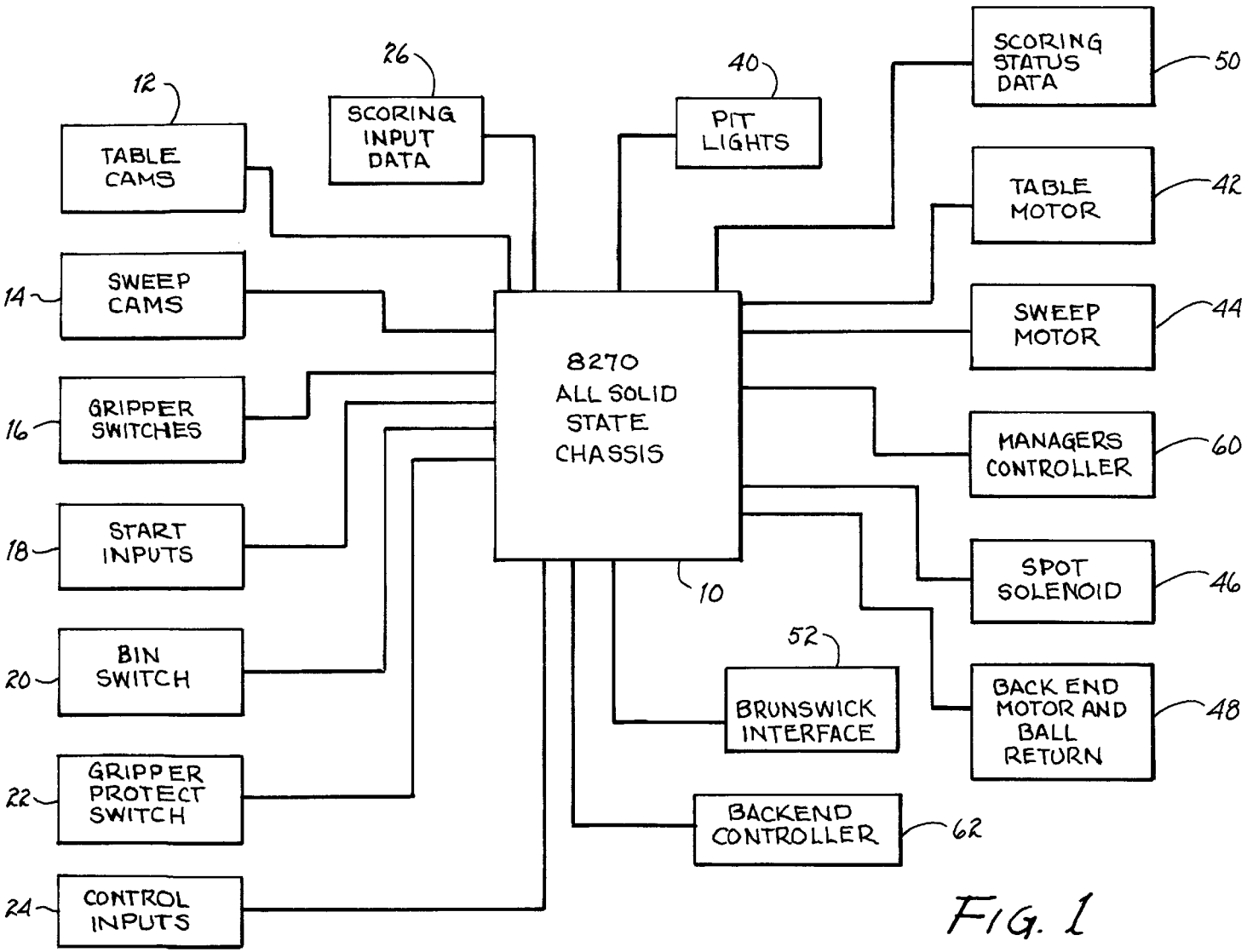
FIG. 1 is a system block diagram of the solid state controller chassis and the components of the 8270 pinspotter which are associated with the chassis.

Referring to FIG. 1, an all solid state controller chassis 20 shown in combination with components of the 8270 pinspotter. The chassis 10 receives a plurality of inputs. The table cams 12 are located on the shaft of the table (not shown) and provide the chassis 10 with information about the table's position. The sweep cams 14 are located on the shaft of the sweep (not shown) and provide the chassis 10 with information about the sweep's position. The ten gripper switches 16 are attached to the ten grippers (not shown) which pick up pins that remain standing after a first bowled ball. The gripper switch 16 is normally open, but closes when a pin is gripped by the gripper. If the gripper switches 16 all remain open during a first ball cycle, then a strike has occurred.

The gripper switches 16 provide the chassis 10 with the same information that cameras from scoring systems provide. Therefore, the gripper switches 16 can be used instead of the more expensive cameras. The start inputs 18 tell the chassis 10 to have the pinspotter execute a cycle of operation. There are four types of start inputs 18. The "cushion ball detect" start input which normally occurs after a ball is bowled. The "tenth frame" start input, which only occurs once per game and is trigger by the scoring input data 26. The "ball detect" start input which is controlled by ball detect electronics. And, the "software signal"start input which is controlled by a com link 59A e.g. (see FIG. 4A). The bin switch 20 tells the chassis 10 that sufficient pins are in the shuttle mechanism to allow the pinspotter to spot ten pins. The gripper protect switch 22 provides the chassis 10 with a signal if the grippers are closed during the first ball cycle. If the chassis 10 receives such a signal, then the table is not allowed to operate in order to prevent the grippers (not shown) from being damaged. The control inputs 24, is connected to the manager's console functions and the pinspotter interface 37 (see FIG. 5). The manager's console functions are "bowl", "off", and "instructomat". "Instructomat" is also referred to as "shadow bowling." The "bowl" position directs the controller to operate in the normal mode. The "off" position directs the chassis 10 to shut down the system. The "instructomat" position directs the chassis 10 to prevent the pinspotter from spotting pins. This allows a bowler to practice without pins. The control inputs 24 also includes the foul input and tenth frame signals which are received from the bowler's area via the pinspotter interface 37 (see FIG. 5). The scoring input data 26 provides the chassis 10 with pin information from the scoring system (not shown). The chassis 10 provides status information includes foul, first or second ball, errors, resets, and activity to the scoring system.

The chassis 10 supplies the pinspotter with a plurality of outputs. The pit lights 40 are used to illuminate the pin deck, or playing surface, (not shown). The pit lights 40 operate from either 115 or 230 VAC and are controlled via a solid state device internal to the chassis 10. The table motor 42 is a capacitor start single phase motor that operates from 115 or 230 VAC. The table motor 42 drives the table of the pinspotter (not shown) whenever table action is required. The table motor 42 is controlled directly from the chassis 10 and this control includes the new breaking method (see FIG. 7B) when operating at 230 VAC. The sweep motor 44 is a capacitor start single phase motor that operates from 115 or 230 VAC. The sweep motor 44 drives the sweep (not shown) as required for the pinspotter cycle. As part of the pinspotter cycle, when activated, the sweep forces the pins or other objects on the pindeck toward the backend of the pinspotter. The sweep motor 44 is controlled directly from the chassis 10 and this control includes the new breaking method (see FIG. 7B) when operating at 230 VAC. The spot solenoid 46 is a means of pulling the spotting latch (not shown). Pulling the spotting latch allows the table to lower during a ball cycle. The spot solenoid 46 can be either 115 or 230 VAC and is controlled directly from the chassis 10. The back end motor and ball return 48 ("the back end motor") is a capacitor start single phase motor that operates from 115 or 230 VAC. The backend motor 48 drives the pin elevator (not shown). The pin elevator picks up the pins from the carpet at the back of the pinspotter and deposits the pins in the distributor (not shown). The same backend motor 48 drives the ball return which picks up the ball from the carpet at the back of the pinspotter and sends the ball towards the bowler. A ball lift (not shown) then lifts the ball to the bowler. The scoring status data 50 provides scoring data to the scoring system (not shown) via a serial data stream of clocked data synchronous with the scoring data. The scoring data includes foul, first or second ball, errors, resets, and activity. The Brunswick interface 52 informs a Brunswick scoring system (not shown) of the latest time that it can score valid data. The Brunswick interface 52 consists of a normally closed switch and a normally open switch which are reversed when it is time to score.

Several components of the pinspotter provide inputs to the chassis 10 and receive outputs from the chassis 10. The manager's area controller 60 allows the manager to control and monitor pinspotter functions for a number of pinspotters. The manager's area controller 60 is one of four ways the manager can select options such as three balls per frame, selective pin spotting, nine pin strike, instructomat, gripper switch override, off spot reset, first ball only, cycle, foul, and backend control. This communication is accomplished using a RS422 serial communication link which is established between the manager's area controller 60 and various chassis (see FIG. 4A). The backend controller 62 is described fully by FIG. 3 and its associated description below.

Figure 2:
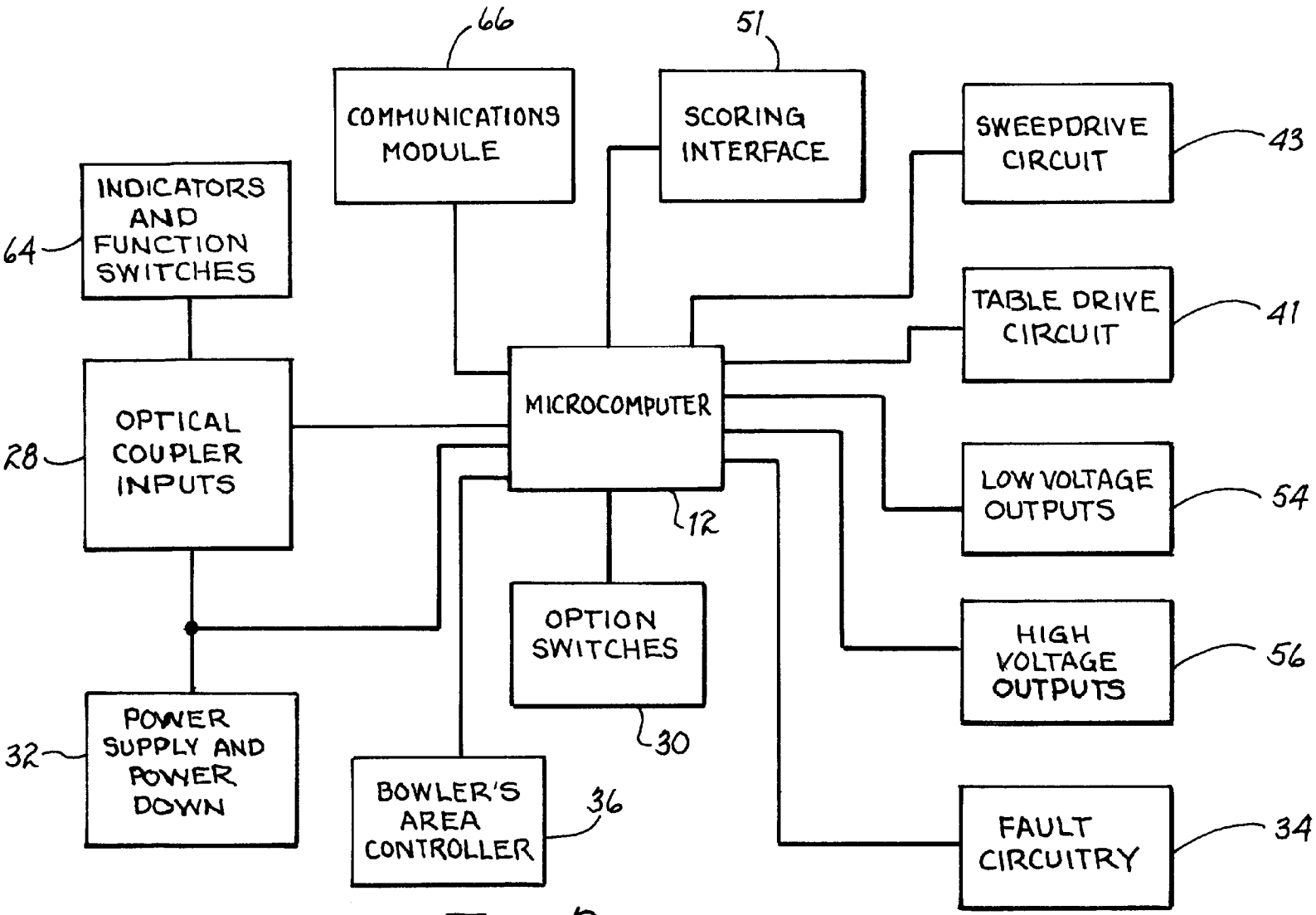
FIG. 2 is a block diagram of the solid state chassis.

Referring to FIG. 2, a more detailed block diagram of the all solid state chassis 10 from FIG. 1 is shown. The heart of the chassis 10 is the microcomputer 12. The microcomputer 12 reads the plurality of inputs, and based on the inputs and its internal programming, it provides a plurality of outputs.

The microcomputer receives a variety of inputs. The optical coupler inputs 28 buffer the inputs to the microcontroller so that 10 noise associated with the external components do not cause false operation. The option switches 30 allow the selection of one of five different cycle options. These options are "no foul", "cycle from the manager's console" (see control inputs 24 from FIG. 1), "no instructomat", "eliminate manual intervention", and "enable backend motor shut down during inactivity". Power supply and power down 32 has three main features. The power supply 32 detects and controls activity during a power failure, provides the drive signals for the power drives, and it protects the drive motors. The fault circuitry 34 detects whether excessive current is being consumed by the high voltage outputs 56 or the low voltage outputs 54. The bowler's area control 36 receives information from the pinspotter interface 37 (see FIG. 6) via the control inputs 24 (see FIG. 1).

The microcomputer 12 provides a variety of outputs. The table drive circuit 41 provides the control signal for the table motor 42 (see FIG. 1). The table drive circuit 41 provides a braking signal when the table motor 42 is not needed. The sweep drive circuit 43 provides the control signal for the sweep motor 44 (see FIG. 1). The sweep drive circuit 43 provides a braking signal when the sweep motor 44 is not needed. The low voltage outputs 54 consist of the indicator, normal foul, strike, one ball, and two ball lights. The high voltage outputs 56 consist of the control circuit for the spot solenoid 46 (see FIG. 1), the control circuit for the respot solenoid, and the power for the pit lights 46 (see FIG. 1).

The microcomputer has associated with it some components which provide inputs and outputs. The indicators and function switches 64 allow the sweep and table to be operated directly from the chassis even during interlock, provides a hard reset, and has light emitting diodes (LEDs) which indicate the status of the chassis 10. The communications module 66 allows for communication with a remote link. The remote link can be hardwired or wireless. The communications module 66 and its associated components are described more fully by FIG. 4B below. The scoring interface 51 sends data to a scoring. If a pinspotter does not have a secondary scoring interface, such as the BRUNSWICK 52 (see FIG. 1), the scoring status data 50 (see FIG. 1) can be used as a substitute. The scoring interface is also in communication with the scoring input data 26 (see FIG. 1).

Figure 3:
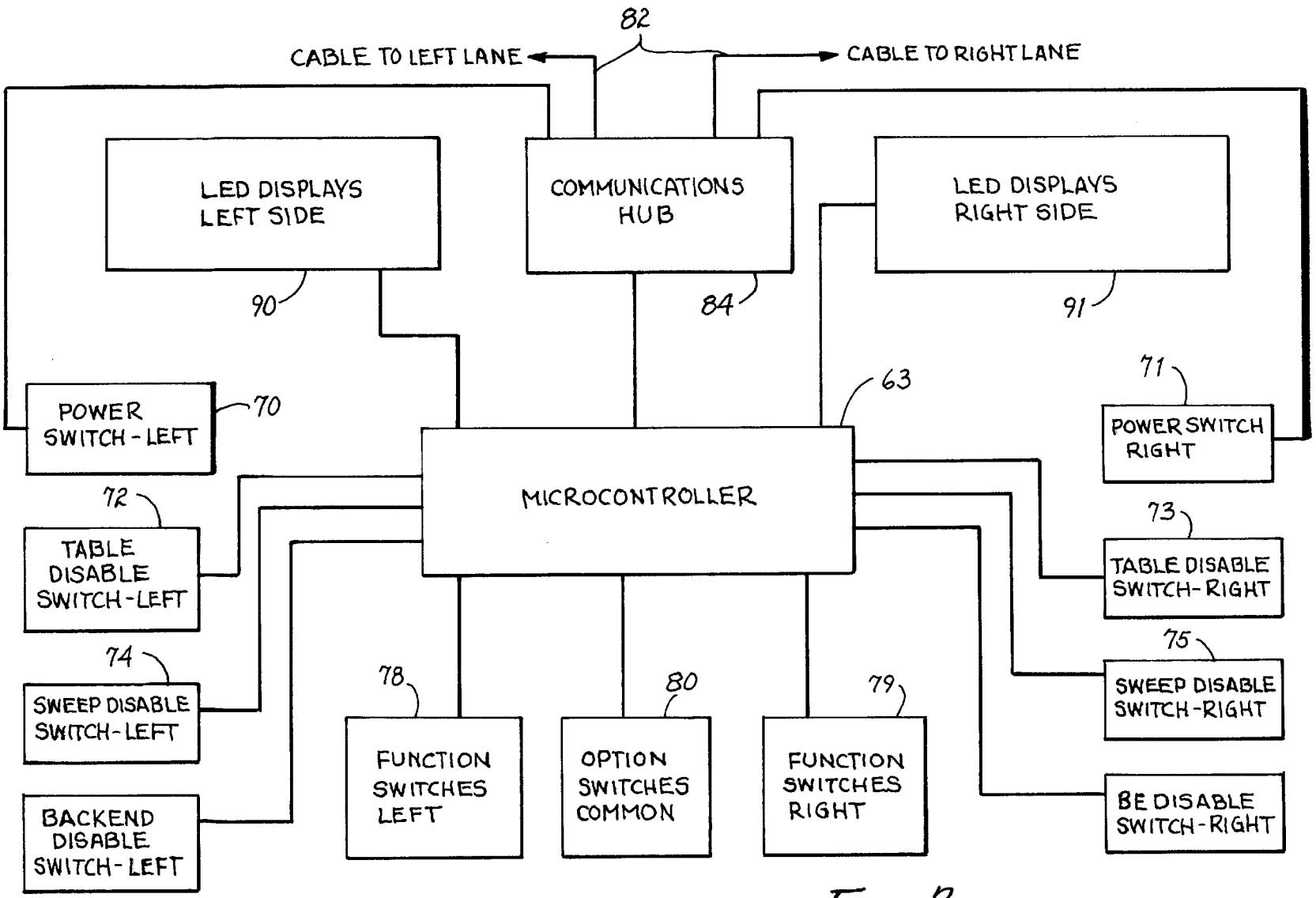
FIG. 3 is a block diagram of the components of the solid state chassis which are associated with the backend controller of the 8270 pinspotter.

Referring to FIG. 3, a more detailed block diagram of the backend controller 62 from FIG. 1 and the components of the pinspotter and scoring system which communicate with the backend controller 62. The heart of the backend controller 62 is a microcontroller 63 that can communicate with two of the all solid state chassis 10 (see FIG. 1). The backend controller 62 provides the chassis 10 with data regarding the status of the pinspotter. The backend controller 62 is connected with each of the two chassis 10 via full duplex serial data communication links 82, also called an "eight wire phone cord", which pass through a communications hub 84 However, any wired or wireless means of connecting the two components could be used. The use of this communication method between the backend controller 62 and the chassis 10 results in reduced wiring required inside the pinspotter. The backend controller 62 provides positive control of the pinspotter being operated by allowing a mechanic located at the backend controller to control the pinspotter operation through the various outputs of the microcontroller 63 which result from the various inputs described below. The backend controller 62 also allows the mechanic to perform diagnostics on the pinspotter. The controller 62 is mounted between the two pinspotters which it communicates with, referred to as ||left|| and ||right|| pinspotters.

The microcontroller 63 receives a variety of inputs. The power switch left 70 and the power switch right 71 allow power to be cut to the left or right pinspotter respectively. The table disable switch left 72 and the table disable switch right 73 allow power to be cut to the table motor 42 (see FIG. 1) associated with the left and right pinspotters respectively. The sweep disable switch left 74 and the sweep disable switch right 75 allow power to be cut to the sweep motor 44 (see FIG. 1) associated with the left and right pinspotters respectively. The backend disable switch left 76 and the backend disable switch right 77 allow power to be cut to the backend motor and ball return 48 (see FIG. 1) associated with the left and right pinspotters respectively. The function switches left 78 and the function switches right 79 allow for the execution of various pinspotter functions from the controller 62 for the respective pinspotters. The microcontroller 63 has an "auto/manual" switch (not shown) which allows the mechanic to turn on each of the pinspotters. The option switches 80 are common to both pinspotters.

The microcontroller 63 has associated with it outputs that are the LED displays left 90 and the LED displays right 91 which display data on the table cams 12 (see FIG. 1) and the switches associated with the respective pinspotters.

The function switches, option switches, and LED displays is used with a press key pad type of interface (see FIG. 8) which allows for a more efficient display and selector switch package.

Figure 8:
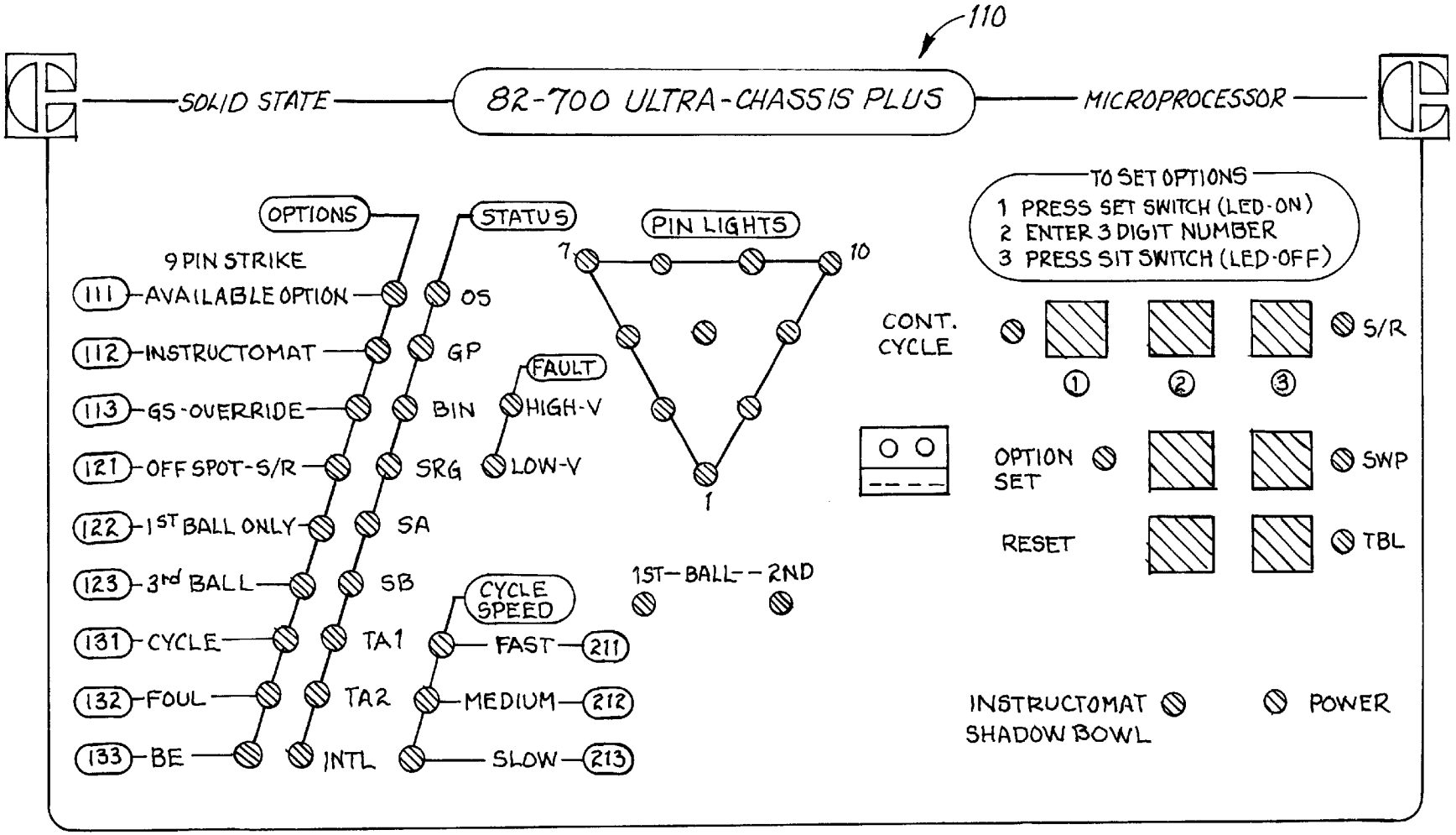
FIG. 8 is a rendering of the press key pad interface for the backend controller or for a stand alone chasis controller.

FIG. 8 shows how options and control features are selected and maintained. These controls operate in one or four ways: (1) as a stand alone chassis (controller) where these features are incorporated on the chasis; (2) as part of a backend controller via a communication link; (3) as part of the manager's control system in the manager's area or at the front desk; and (4) as part of a communications and monitoring net located in the lane mechanics operations area.

Several new options may be implemented with the present invention. They include: (1) 9-PIN STRIKE—This allows the manager or proprietor to set up the bowling lane so that anytime a bowler knocks down 9 pins a strike cycle is executed; (2) GS OVERRIDE—This feature allows the mechanic to execute a normal first ball cycle when scoring is used and gripper switches have been removed; (3) OFF SPOT S/R—This feature allows the sweep which normally stays in the forward guard position after an off spot to sweep reverse allowing a second ball cycle without mechanic intervention; (4) 1ST BALL ONLY—This feature allows the bowler to always bowl a first ball with a full deck of pins; (5) 3-BALL—This feature places the pinspotter in a three cycle operation for bowling. These cycles are first ball and second ball if needed, then third ball if needed and then back to first ball; (6) CYCLE SPEED—This feature allows the manager the option to select the speed of operation of the pinspotter. Three speeds are provided fast, medium, and slow. The speed control selects the time delay between the time the sweep drops to the forward guard and either the sweep moves again or the table starts down.

Figure 4B:
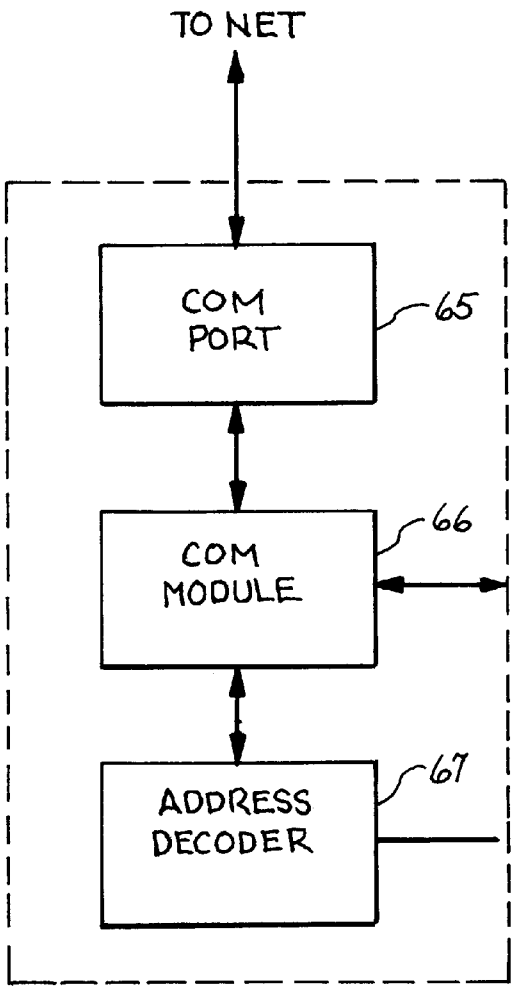
FIG. 4B is a block diagram of a com link box.
Figure 4A:
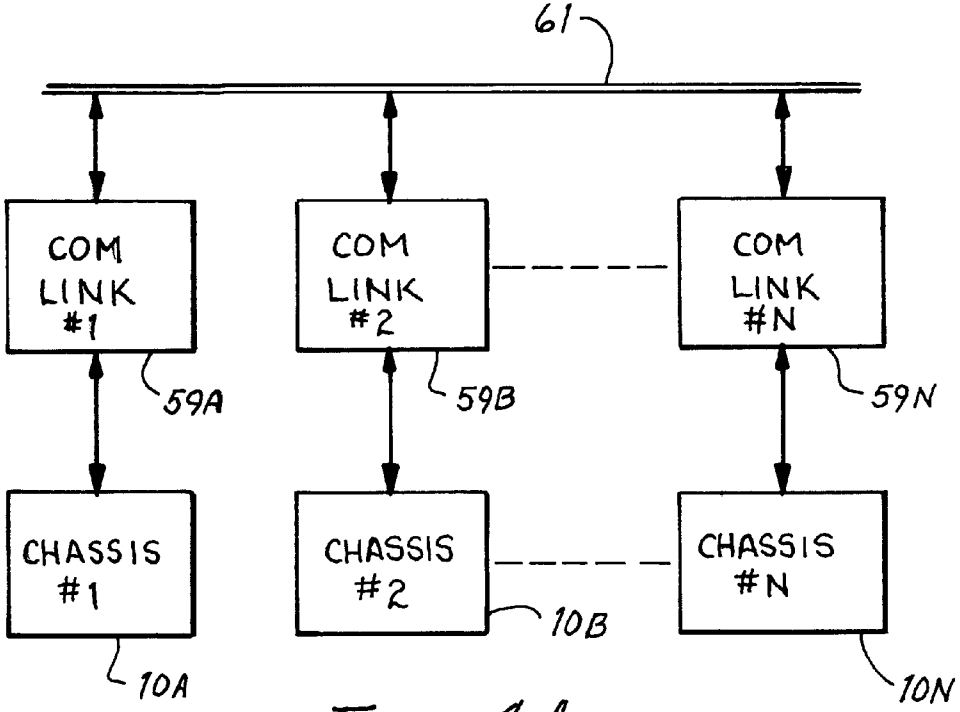
FIG. 4A is a block diagram of the connection between various com link boxes and associated chassis.

Referring to FIG. 4A, the communications link between several chassis 10A, 10B, and 10N each of which is an example of the chassis 10 (see FIG. 1) and the manager's area controller 60 (see FIG. 1) is shown in block diagram. A common network is used to form the com links 59A. 59B, and 59N, which allow communication between the manager's area controller 60 and the several chassis 10A, 10B, and 10N. The number of chassis that can be linked is unlimited. The common network is linked by a single hard wire data cable 61 running from the manager's area controller 60 to the various chassis. The first portion of the data stream from the manager's area controller 60 is the address of a particular chassis, for example 10B. Only the targeted chassis, via its com link, e.g. 59B, will recognize the command sent via the data stream. The chassis, in the example 10B, then sends the requested data or performs the function commanded. The chassis, 10B, then disables itself and waits for another command.

Referring to FIG. 4B, a more detailed block diagram of one of the com links 59A, 59B, 59N, of FIG. 4A. Each com link has a com port 65 which receives data from the common network and passes the data on to the communications module 66 (see FIG. 2). The communications module 66 converts the data stream into digital form. The communication module 66 then communicates with the address decoder 67. If the first part of the data stream matches the address of the chassis 10 (see FIG. 1), then the entire decoded data stream is sent to the chassis 10 via a communication path from the communications module 66 to the microcomputer 12 (see FIG. 2). The chassis 10 then responds to the data received based on the type of command received. The chassis 10 will always acknowledge that data has been received. Part of the chassis' response will include information on the status of the pinspotter.

Figure 5:
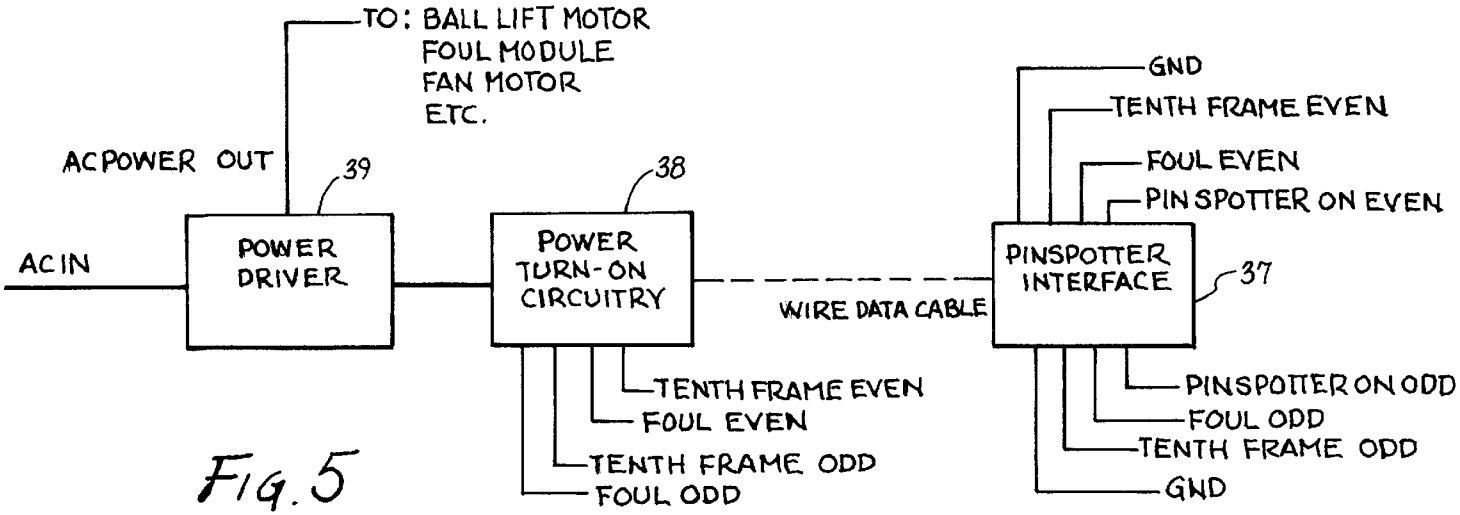
FIG. 5 is a block diagram of the front to rear components and interface.

Referring to FIG. 5, a block diagram of the front to rear control connection and the pinspotter interface 37. The bowler's area is common to two bowling lanes. The lanes are designated left (or odd) and right (or even). In order to return the bowling ball to the bowler the backend motor and ball return 48 (see FIG. 1) picks the ball up from the carpet and places the ball on a track which terminates in the bowler's area. The gravity and momentum are used to move the ball to the bowler's area where a ball lift (not shown) lifts the ball to the bowlers. When the pinspotter is activated, the ball lift is turned on by a signal from the pinspotter. The chassis 10 (see FIG. 1) sends a 24 VAC signal to the pinspotter interface 37. The pinspotter interface 37 transforms the signal into a DC signal which is sent to the power on circuitry 38 at the lane interface (not shown) via an eight wire data cable. The power on circuitry 38 then sends a control signal to the power drive 39. The power drive when turned on uses higher voltage to drive a ball lift motor (not shown), the foul module (not shown), and the hand dryer fan motor (not shown). When a bowler crosses the foul line, a signal is generated which is sent to the pinspotter interface 37 via the lane interface (not shown) and the eight wire data cable. The lane interface transforms the signal from AC to DC prior to sending it to the pinspotter interface 37. In a similar manner, a tenth frame signal is sent to the scoring interface via the eight wire data cable. One lane interface and data cable are used for both the right and left lanes. The use of the eight wire data cable in combination with the describe components results in an easy to install, reliable, positive control device for the bowler's area.

Figure 6:
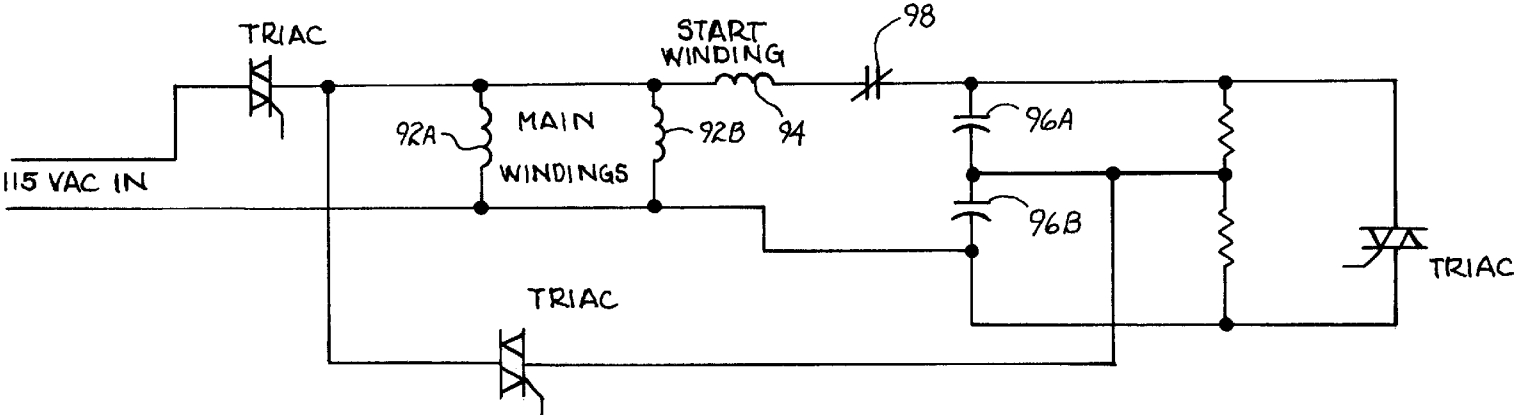
FIG. 6 (PRIOR ART)
FIG. 6 is a schematic diagram of the old 115 VAC breaking method.

Referring to FIG. 6, which is a schematic diagram of the present method of breaking at 115 VAC. The table motor 42 (see FIG. 1), the sweep motor 44 (see FIG. 1) and the backend motor 48 (see FIG. 1) are single phase capacitor start motors which operate at 115 VAC, 230 VAC, or are dual voltage and can operate at either voltage depending upon how they are wired. Braking of these motors is accomplished by using the energy which is stored as the motors are running. As soon as the power is cut to these motors, the stored energy is available to be used for braking. The key to the present invention is to maintain the capacitance of the start capacitor and the value of the inductance of the motor at a relatively constant level. The two main windings of the motor 92A and 92B are in parallel and the start winding 94 operates in parallel with the main windings 92A, and 92B. During breaking, the two capacitors 96A and 96B are switched so that they are in parallel with each other. When the start switch 98, which is a centrifugal switch, closes as the motor slows down, braking occurs because the energy stored in the inductance and capacitance system is shunted through the start winding 94. This causes the motor to come to an abrupt halt.

Figure 7A:
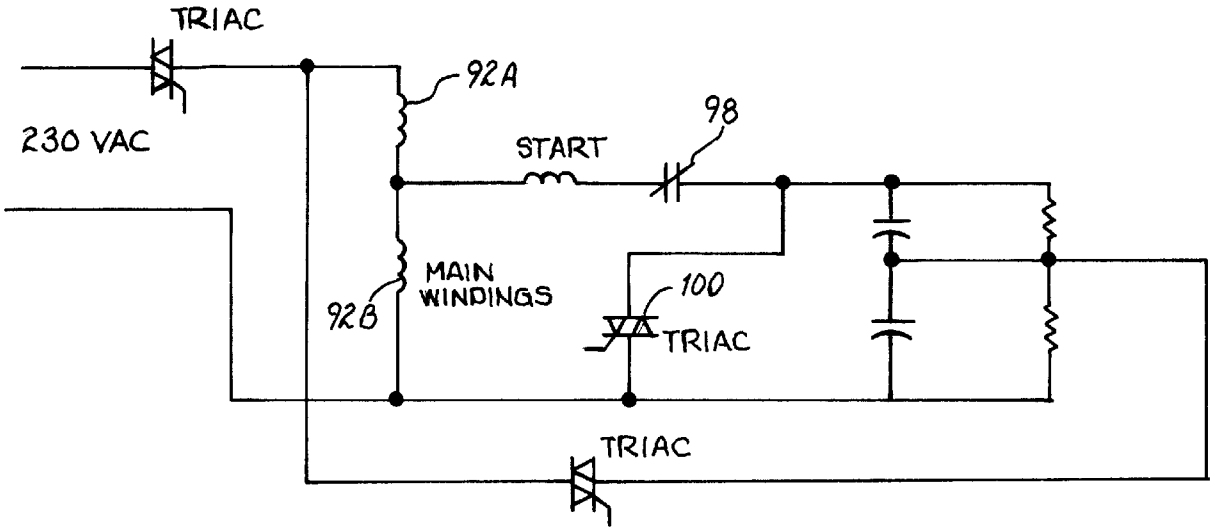
FIG. 7A (PRIOR ART)
FIG. 7A is a schematic diagram of the old 230 VAC breaking method.

Referring to FIG. 7A, which is a schematic diagram of the present breaking method at 230 VAC. The two main windings of the motor 92A and 92B are in series and the start winding 94 and capacitors 96A and 6B are driven from the center tap of the main windings 100A and 100B, through the start switch 98. A triac 100 is shown with one end connected after the start switch 98 and the other end on the common.

Figure 7B:
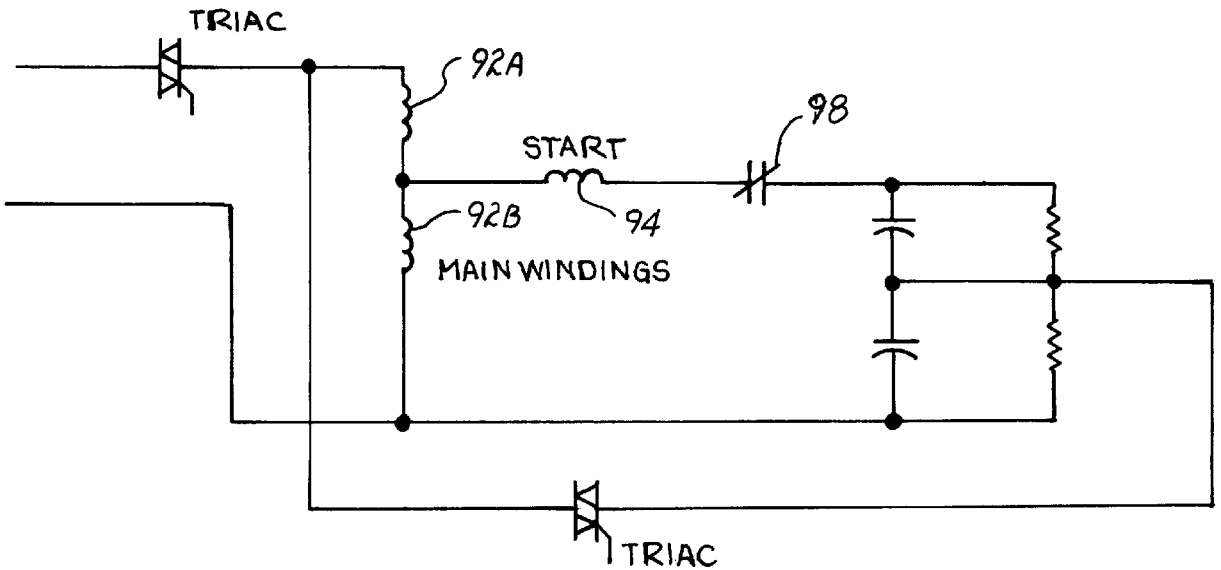
FIG. 7B is a schematic diagram of the new 230 VAC breaking method.

Referring to FIG. 7B, which is a schematic diagram of the new breaking method at 230 VAC. By removing the triac 100 (see FIG. 7A) the capacitance remains and inductance remains constant which results in sufficient energy at braking to cause the motor to come to an abrupt halt. The energy of the system remains fairly constant and is close to that of the 115 VAC system of FIG. 6.

Referring to FIG. 8, which is a rendering of the press key pad interface 110 for the backend controller. The LED indicator lights are generally on the left two-thirds of the rendering, and the control switches are generally on the right one-third of the drawing.

Although the invention has been particularly shown and described with reference to a preferred embodiment, it will be understood by those skilled in the art that changes in form and detail may be made without departing from the spirit and scope of the invention.

What is claimed is:

1. A backend controller for controlling the operation of a bowling pinspotter chassis and its accompanying pinspotter comprising, in combination:

a microcontroller means for controlling the operation of the pinspotter by receiving inputs from a plurality of elements coupled to said microcontroller means and producing an output signal to control said pinspotter based on said outputs; and a data communication means for carrying the output signal from the microcontroller means to the bowling pinspotter chassis.

2. A backend controller in accordance with claim 1 further comprising a press key pad interface means for communicating with the microcontroller means.

3. A backend controller in accordance with claim 1 wherein said data communication means is a full duplex serial data communication link.

4. A backend controller in accordance with claim 1 further comprising a power switch means coupled to said chassis for controlling the power to the pinspotter.

5. A backend controller in accordance with claim 1 further comprising a table disable switch coupled to said microcontroller means for controlling the power to a table motor.

6. A backend controller in accordance with claim 1 further comprising a sweep disable switch coupled to said microcontroller means for controlling the power to a sweep motor.

7. A backend controller in accordance with claim 1 further comprising a backend disable switch coupled to said microcontroller means for controlling the power to a backend motor.

8. A backend controller in accordance with claim 1 further comprising a function switch coupled to said microcontroller means for choosing options for operation of the pinspotter.

9. A backend controller in accordance with claim 8 wherein said options are selected from a group consisting of: 9 pin strike, gripper switch override, off spot sweep reverse, 1st ball only, 3rd ball, cycle speed, and combinations thereof.

10. A backend controller in accordance with claim 1 further comprising LED displays coupled to said microcontroller means for displaying data concerning the operation of the chassis and pinspotter.

11. A bowling pinspotter control system for controlling the operation of a bowling pinspotter chassis and its accompanying pinspotter comprising, in combination:

a managers area controller means for controlling and monitoring a number of pinspotters by receiving inputs from a plurality of elements and producing a serial data output; and data communication means for transporting the inputs and the serial data output between the manager's area controller means and the number of bowling pinspotter chassis.

12. The bowling pinspotter control system of claim 11 wherein the data communication means includes a RS422 serial communication link means for communicating between the manager's area controller and the number of bowling pinspotter chassis.

13. The bowling pinspotter control system of claim 11 wherein the data communication means includes a communication link means for receiving data from a common network, converting the data stream into digital format, recognizing a command signal for a particular chassis, and sending the command signal to the chassis.

14. A bowling pinspotter control system for controlling the operation of a bowling pinspotter chassis and its accompanying pinspotter comprising, in combination:

pinspotter interface means for receiving a signal from the chassis and transforming the signal;

a power drive means for driving higher voltage equipment in the bowler's area;

power on circuitry means for controlling the power drive means; and data communication means for carrying the signal from the pinspotter interface to the power on circuitry means.

15. A bowling pinspotter according to claim 14 wherein the data communication means is a full duplex serial data communication link.

16. A motor wiring system for braking motors associated with pinspotters operating at 230 VAC comprising, in combination:

a start winding:

a start switch having a first and a second contact, the start switch being wired to the start winding at a first contact;

a common wired to the second contact of the start switch via capacitors and resistors; and the absence of a triac between the common and the second contact of the start switch.

17. A method of providing a bowling pinspotter control system for controlling the operation of a bowling pinspotter chassis and its accompanying pinspotter comprising, the steps of:

providing microcontroller means for controlling the operation of the pinspotter by receiving inputs from a plurality of elements coupled to said microcontroller means and producing an output signal to control said pinspotter based on said outputs; and providing data communication means for carrying the output signal from the microcontroller means to the bowling pinspotter chassis.

18. The method of claim 17 further comprising the step of providing a press key pad interface means for communicating with the microcontroller means.

19. The method of claim 17 wherein said data communication means is a full duplex serial data communication link.

20. The method of claim 17 further comprising the step of providing a power switch means coupled to said chassis for controlling the power to the pinspotter.

21. The method of claim 17 further comprising the step of providing a table disable switch coupled to said microcontroller means for controlling the power to a table motor.

22. The method of claim 17 further comprising the step of providing a sweep disable switch coupled to said microcontroller means for controlling the power to a sweep motor.

23. The method of claim 17 further comprising the step of providing a backend disable switch coupled to said microcontroller means for controlling the power to a backend motor.

24. The method of claim 17 further comprising the step of providing a function switch coupled to said microcontroller means for choosing options for operation of the pinspotter.

25. The method of claim 24 wherein said options are selected from a group consisting of: 9 pin strike, gripper switch, override, off spot sweep reverse, 1st ball only, 3rd ball, cycle speed, and combinations thereof.

* * * * *